US011794202B2

(12) United States Patent
Kasting et al.

(10) Patent No.: US 11,794,202 B2
(45) Date of Patent: Oct. 24, 2023

(54) WASHABLE, MODULAR PUMP

(71) Applicant: RIEKE LLC, Auburn, IN (US)

(72) Inventors: Thomas P. Kasting, Fort Wayne, MI (US); Dale W. Taylor, Hamilton, IN (US)

(73) Assignee: RIEKE LLC, Auburn, IN (US)

( * ) Notice: Subject to any disclaimer, the term of this patent is extended or adjusted under 35 U.S.C. 154(b) by 0 days.

(21) Appl. No.: 17/621,343

(22) PCT Filed: Jun. 24, 2020

(86) PCT No.: PCT/US2020/039278

§ 371 (c)(1),
(2) Date: Dec. 21, 2021

(87) PCT Pub. No.: WO2020/263920

PCT Pub. Date: Dec. 30, 2020

(65) Prior Publication Data

US 2022/0355322 A1 Nov. 10, 2022

Related U.S. Application Data

(60) Provisional application No. 62/865,520, filed on Jun. 24, 2019.

(51) Int. Cl.

| | |
|---|---|
| ***B05B 11/00*** | (2023.01) |
| ***B05B 11/10*** | (2023.01) |
| ***B05B 15/50*** | (2018.01) |

(52) U.S. Cl.

CPC ..... *B05B 11/1043* (2023.01); *B05B 11/1067* (2023.01); *B05B 15/50* (2018.02)

(58) Field of Classification Search

CPC . B05B 11/1043; B05B 11/1067; B05B 15/50; B05B 11/1047; B05B 11/0089; B05B 11/0064

See application file for complete search history.

(56) References Cited

U.S. PATENT DOCUMENTS

| | | | | |
|---|---|---|---|---|
| 2,519,640 | A * | 8/1950 | Echols, Sr. ..... | B67D 1/101 417/547 |
| 5,381,932 | A | 1/1995 | Humphrey | |
| 6,019,256 | A | 2/2000 | Seltzer | |
| 6,450,373 | B1 | 9/2002 | Seltzer | |
| 7,377,408 | B2 | 5/2008 | Kasting et al. | |
| 8,827,121 | B2 | 9/2014 | Law et al. | |
| 8,960,507 | B2 | 2/2015 | Sciole | |
| 2010/0006604 | A1 | 1/2010 | Ding | |

FOREIGN PATENT DOCUMENTS

| | | | |
|---|---|---|---|
| CN | 109018666 | A | 12/2018 |
| WO | 1998034733 | A1 | 8/1998 |

OTHER PUBLICATIONS

Patent Cooperation Treaty (PCT), International Search Report and Written Opinion for Application PCT/US2020/039278 filed on Jun. 24, 2020, dated Sep. 10, 2020, International Searching Authority, US.

* cited by examiner

*Primary Examiner* — Vishal Pancholi
(74) *Attorney, Agent, or Firm* — McDonald Hopkins LLC

(57) ABSTRACT

An easy-to-disassemble pump with a replaceable, ergonomic shroud is contemplated. The pump components snap-fit and allow the user to easy access and clean its interior. Further, the internal components ensure sufficient suction is provided to minimize or avoid entrapment of fluid on exposed portions of the pump.

18 Claims, 8 Drawing Sheets

WASHABLE, MODULAR PUMP

CROSS REFERENCE TO RELATED APPLICATIONS

This application is a 35 U.S.C. § 371 national stage applications of PCT Application No. PCT/US2020/039278 filed on Jun. 24, 2020, which claims priority to U.S. provisional patent application No. 62/865,520, filed Jun. 24, 2019, each of which are incorporated by reference herein in their entireties.

TECHNICAL FIELD

The present invention relates to fluid dispenser and, more particularly, to an improved pump design that allows for easier disassembly, cleaning, and sanitization of its constituent components.

BACKGROUND

Owing to their ability to deliver small doses of fluids from a bulk container, dispensing pumps coupled to containers find particular utility in the food service industry. Specifically, these arrangements allow food service providers to acquire foodstuffs in bulk and then subsequently and selectively use these items as toppings and/or flavorings as may be appropriate to the circumstances. A further efficiency is realized insofar as the container and pump combination itself can be cleaned and reused.

One example of a dispensing pump that is appropriate for use in the food service industry can be found in U.S. Pat. No. 8,960,507. Here, a weir is provided to prevent residue from building up within the dispensing channel/outlet of the pump. U.S. Pat. Nos. 7,377,408 and 8,827,121 provide other examples of pump dispensers. All of these disclosures are fully incorporated herein by reference.

Thus, as seen in FIG. 1, reciprocating pump 45 is selectively attachable to a container 21 by way of closure 23. A flowable product is drawn into pump 45 at inlet 25. After passing through inlet ball valve 27, it enters the housing 26. Spring 29 cooperates with piston 28 and plunger stem 54 to reciprocate and selectively create suction force within the hollow chamber of the housing 26. Continued actuation fills the chamber with fluid and eventually displaces outlet ball valve 49 positioned within dispenser head 47 to expel fluid through outlet 48 and down dispensing channel 46. Notably, spring 29 provides biasing force to lift plunger 54, while piston 28 is temporarily displaced to create suction to draw the fluid into the housing 26.

The chamber into which fluid is primed and ultimately dispensed, resides between inlet ball valve 27 and outlet ball valve 49. This arrangement requires the dispenser head 47 to be shaped so that it can be disassembled to allow for positioning and access to the valve 27. Additionally or alternatively, the dispenser head 47 may coupled to stem 54, with the stem 54 subsequently passing through the closure 23 and/or coupling to the piston 28. These arrangements create a multiplicity of sealing faces is required, which each provide an opportunity for leakage, contamination, and further complexity in manufacture and disassembly of the pump 45.

The ability to clean and sanitize the internal components presents a significant challenge for manufacturers of pumps made specifically for food service. Often, these pumps involve a plurality of valves and other distinct structures that can be difficult to access, clean, and reassemble.

Therefore, a modular pump that could be disassembled and reassembled easily and without the need for tools is needed. To the extent these parts avoid or minimize reliance on small apertures (e.g., duckbill valves which limit the overall size of particulates carried in a foodstuff), tortuous and/or inaccessible openings, and the like, such designs would be welcome. Finally, a pump that minimizes or eliminates dripping and leaking when it is not in use is most ideal.

SUMMARY

The design contemplates improvements to: (a) the piston/pump body with improvements to the inlet and outlet valves; and (b) the aesthetics of the pump dispensing head itself. In particular, a piston slider receives and couples to a ball valve structure having a circular, through-hole retaining cage at the outlet, while a corresponding flap valve or an open ball restraint is positioned at the inlet. The dispenser head includes an ergonomic shell that is removably snap-fitted to an interior support skeleton.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure.

In the drawings and attachments, all of which are incorporated as part of this disclosure:

FIG. 2E is a perspective view of the ball cage insert illustrated in FIG. 2A, while

FIG. 3B is a partial cross sectional side view of a second aspect of the inlet of the pump mechanism, while

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Any descriptions and drawings in this disclosure, and any written matter within the drawings, should be deemed to be reproduced as part of this specification. Unless noted to the contrary, all measurements are with reference to ambient temperature and pressure relying on industry-standard tests (e.g., protocols published by relevant trade and technical organizations, including the American Standard Test Methods, etc.), while appropriate percentages or ratios are with reference to weight unless context dictates to the contrary.

Figure 1:
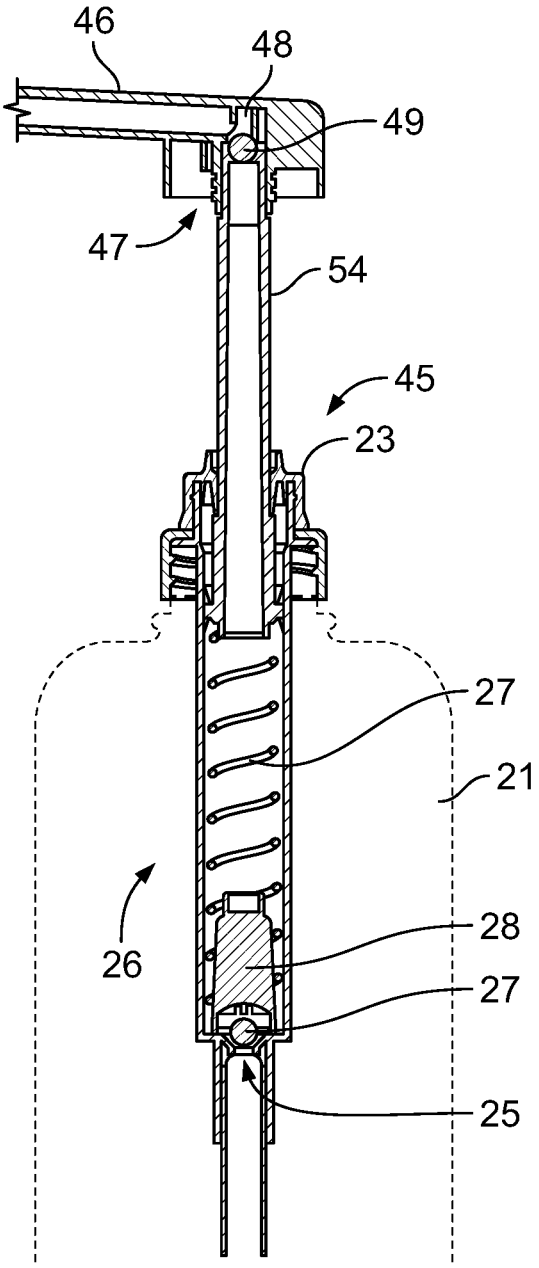
FIG. 1 is a cross sectional side view of pump mechanism according to the prior art.
Figure 2A:
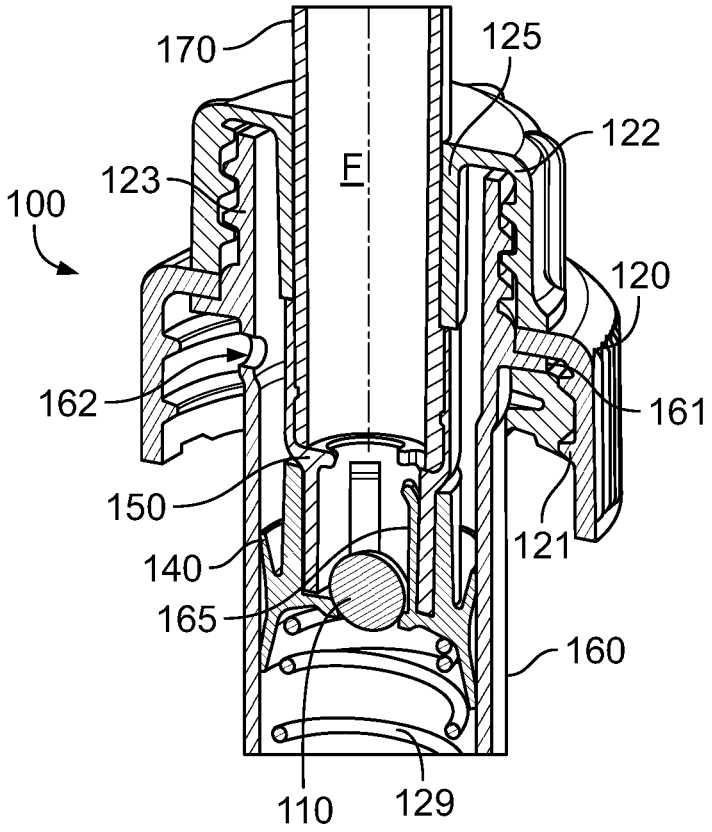
FIG. 2A is a partial perspective cross sectional side view of the outlet of a pump mechanism.

One aspect of the improved outlet 100 is illustrated beginning in FIG. 2A. Here, the outlet ball valve 110 is removed from its position within the dispenser head and, instead, placed proximate to the positioning of the closure 120 (when the plunger 130 and piston 140 are in the extended position). Spring 129 biases the components carried by piston 140 into that extended position.

Closure 120 include attachment means 121, such as screw threads, cooperating tabs, bead-and-groove, or other known container sealing mechanisms based upon interference, rotatable, or snap fittings. Closure 120 is a hollow cylinder with a general cup shape (i.e., a tube enclosed at one end by a flat panel, thereby defining an interior volume), although a central aperture is positioned in the top panel to allow other components associated with outlet 100 to pass therethrough. In some aspects, a chaplet 122 is provided adjacent to, and usually above, closure piece 120. The chaplet 122 attaches to housing 160, which includes an annular attachment flange 161 so as to capture and hold the closure 120 and chaplet 122 together.

Chaplet 122 is also a hollow cylindrical tube (similar to closure 120), with attachment means 123 (similar to the structures disclosed in attachment means 124 and elsewhere throughout this disclosure) coupling the chaplet 122 to the housing 160. Thus, flange 126 and sidewall/skirt 127 of closure 120 define an annular gap into which the top edge of housing 160 is received. Conversely the bottom edge of flange 125 presents a flattened abutment that comes into contact with the top edge of the piston, so as to act as a stopper restraining the ball cage insert 150 at its upper range of motion. As such, insert 150 can be attached to piston 140, as described below, or provided so that the insert 150 is slidably received within the piston 140 but remains coupled to the flange 125 on the pumping down stroke. In either arrangement, by coupling the insert 150 proximate to the bottom edge of the plunger stem 170, all sealing interfaces in pump are retained beneath the closure 130 so that leakage or failure of a sealing interface merely results in fluid flowing back into the container to which the closure 130 is coupled.

Housing 160 is a hollow cylinder fitted concentrically within the central aperture of the closure 120 and chaplet 122. In this manner, housing 160 defines the pump chamber for receiving and temporarily holding fluid from the container. Housing 160 encases spring 129, piston 140 (with ball cage insert 150 attached thereto), and the bottom portion of plunger stem 170. An axial flange 125 is aligned in a substantially parallel orientation relative to the sidewalls 126 of chaplet 122.

Figure 2B:
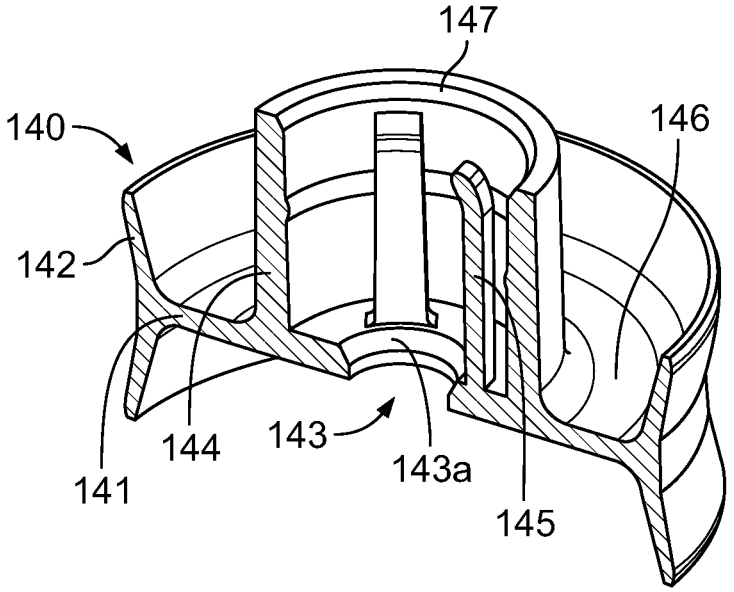
FIG. 2B is cross sectional perspective view of the piston according to the aspect illustrated in FIG. 2A.
Figure 2C:
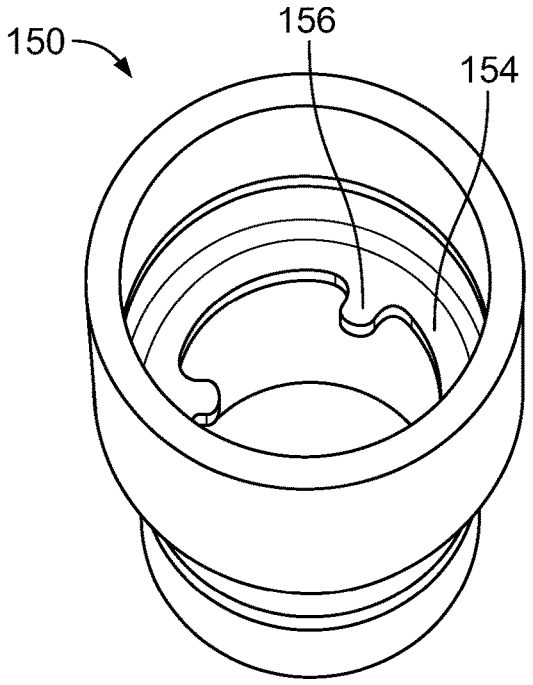
FIG. 2C is a top perspective view and FIG. 2D a bottom perspective view of that ball cage insert.
Figure 2D:
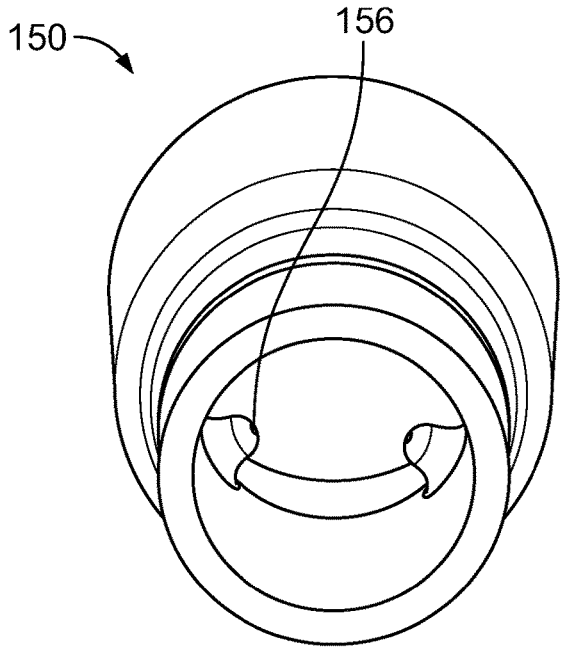
Figure 2E:
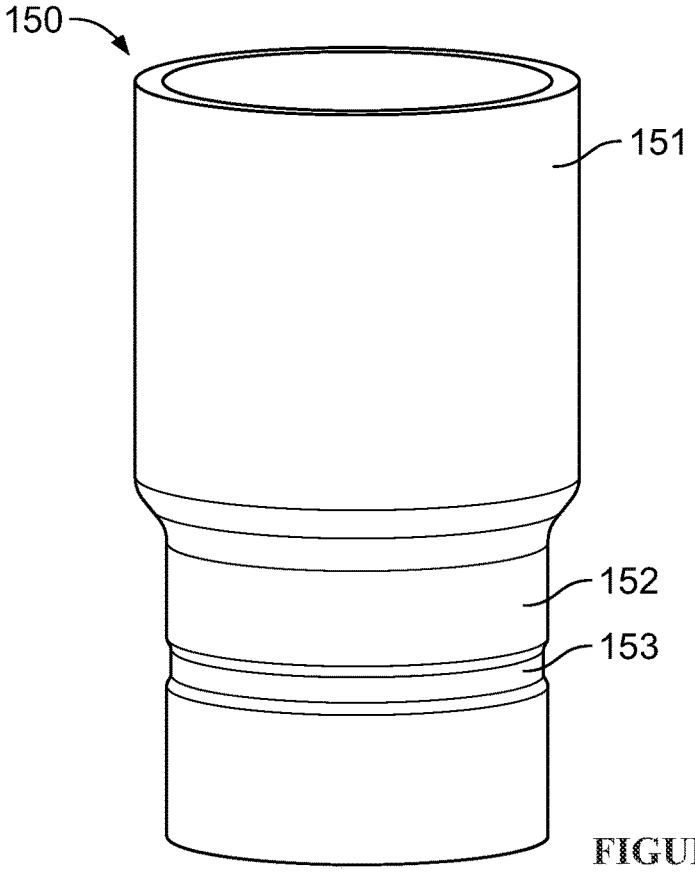

Piston 140 includes a central disc 141 which cooperates with radial extending, peripheral flange 142 to create a seal conforming to the interior sidewalls of housing 160. Flange 142 extends axially parallel to the sidewalls, but preferably at slight angles relative to vertical, above and below the plane defined by disc 141 (thereby imparting an H-shape to disc 141 and flange 142 combination when viewed in cross section, e.g., as seen in FIG. 2B). As such, flange 142 serves as a "wiper" coming into contact with the housing 160 interior wall, with the angle facilitating fluid flow toward a, through-hole or aperture 143 at the central axis of disc 141. Aperture 143 includes an angled or beveled edge 143*a* which serves as a seat for outlet ball 110, with gravity urging the ball 110 into a sealed relationship with edge 143*a*.

Attachment cylinder 144, like disc 141, flange 142, and aperture 143, is formed integrally as part of piston 140. Cylinder 1444 extends upward from the disc 141 so as to surround the aperture 143. Ball cage insert 150 is received on the interior of cylinder 144 so as to form a fluid seal. This attachment may occur by way of a bead-and-groove 147 arrangement, although other attachment means could be employed. In this manner, piston 140 and ball cage 150 move as a single piece but may be easily detached and assembled. The inner diameter of the cylinder 144 should be sufficient to receive both the insert 150 and the outlet ball 110.

A plurality of axially extending ball retention members 145 may be formed concentrically within cylinder 144 to serve as a ball cage that restrains the outlet ball 110. Member 145 keep the ball 110 under control during pump disassembly. Relying on a minimal number of members 145 (e.g., three) ensures ball 110 can be easily removed and replaced as required, but will not be able to fall free and potentially become lost during disassembly and reassembly of the outlet 100. Members 145 may be formed as elongated fingers having a substantially vertical orientation (i.e., parallel to the axis of reciprocation of the pump) with slightly bent and/or curved ends to restrain the ball 110. In this embodiment, the upper portion of members 145 guide and redirect the ball 110 as it is pushed upward by the outflowing fluid passing through aperture 143, although in a resting position it may still be possible to remove the ball 110 by slipping it between the members 145 proximate to the aperture 143.

The annular gap 146 between cylinder 144 and top portion of flange 142 can be varied so as to accommodate different diameters for the housing 160. In turn, this will vary the volume and overall dispensing capacity of the pumping chamber defined within the housing 160. Also, the bottom facing of disc 141 should be of a construction to maintain contact with the top end of spring 129 while simultaneously withstanding the biasing force exerted thereby.

Insert 150 is a hollow cylindrical tube that concentrically couples to cylinder 144. Insert 150 may attach by interference or screw fitting, similar to the other attachment means contemplated herein. A top portion 151 has a larger outer diameter in comparison to bottom portion 152. A bead or groove 153 is disposed on the exterior surface of insert 150, preferably within bottom region 152, so as to couple to the corresponding structure 147 on the inner facing of cylinder 144. The attachment formed thereby must be sufficient secure to withstand the forces exerted by pump actuation but still permit a user to selectively decouple and disassemble piston 140 and insert 150 to allow for cleaning thereof.

Along an inner facing of insert cylinder 150, annular ridge 154 defines the top edge of a ball cage, with one or more (preferably at least three) radially protrusions flanges 156 to serve as a restraint for ball 110 as it moves up and down through the interior of bottom portion 152. Further, the annular spacing provided by protrusions 156 (i.e., between ball 110 and inner side walls of insert 150) to facilitate fluid communication with channel F, which is defined by the hollow interior volume of plunger stem 170.

Notably, the height of insert 150 allows for enough vertical movement of the ball 110 to create such suction (in combination with the pumping stroke and movement of the piston 140). As such, the positioning of outlet 100 proximate to the closure 120 interface ensures there will be sufficient space (as opposed to the positioning of outlet valve within the dispenser head, where spatial and aesthetic concerns may limit the range of motion that can be impart to the outlet ball). In the same manner, disposing the protrusions 156 at the transition point between the larger diameter top portion 151 and the smaller diameter bottom portion 152 serves as a failsafe in the event the ball is dislodged from the ball cage formed on piston 140. While a concentric circular web with radial spokes could serve the same purpose as protrusions 156, minimizing the obstructions within the inner channel defined by insert 150 will simplify cleaning of that part.

The "suck back" created by outlet 100 ensures that the inventive is less susceptible to entrapment of fluid in flow channel F. This allows for a more sanitary arrangement. A weir may also be provided in the flow channel F as it runs horizontal through the dispenser head, similar to that disclosed in U.S. Pat. No. 8,960,507, which is incorporated herein by reference. As a final measure in this regard, the orientation of flow channel F is substantially horizontal (+/− no more than 10° from horizontal and, more preferably slightly angled/inclined upward so that fluid flows back down toward outlet 100).

Finally, with respect to insert 150, the top most edge of top portion 151 will abut the cylinder 126 of chaplet 122. Thus, these elements must have cooperating inner and outer diameters. In particular, the inner diameter must be sufficient to receive plunger stem 170, while the outer diameters provide sufficient horizontal surface to serve as a stop against the upward biasing force of the spring 129. Further, the inner diameter of the top portion 151 of insert 150 should not "stick" or create an interference fit with stem 170.

Returning to housing 160, a vent 162 is disposed proximate to the closure 120. Vent 162 ensures make up air is admitted during pump actuation. A corresponding vent, aperture, or flowpath can be provided in or between one or both of the closure and container so as to keep ambient pressure equilibrated to the head space within the fluid-holding container. Alternatively, vents can be omitted altogether, so long as the container can withstand or accommodate (e.g., collapse inward) pressure differentials.

Figure 3A:
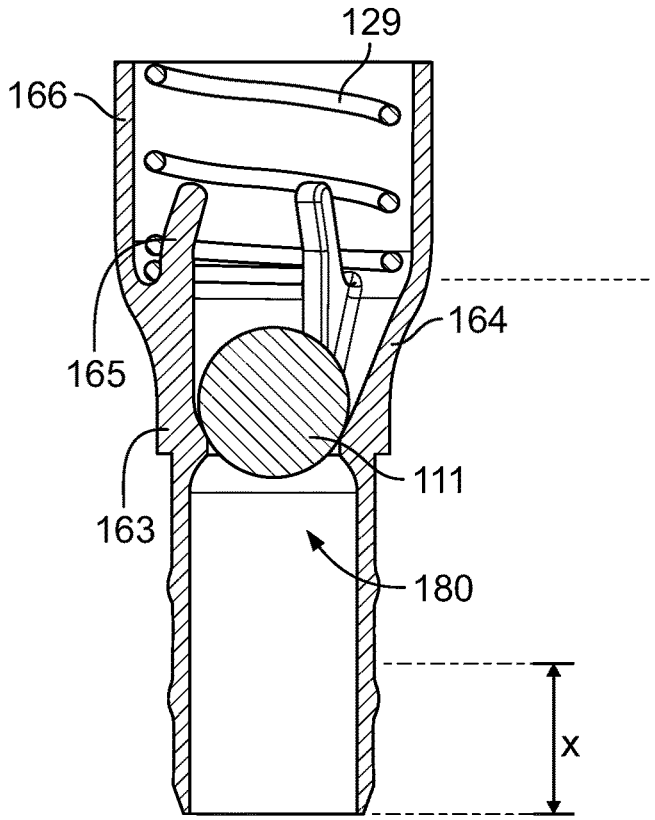
FIG. 3A is a partial cross sectional side view of a first aspect of the inlet of the pump mechanism.

At the bottom end 163 of housing 160 (i.e., the end disposed within the inner volume of the container), inlet valve 180 is contemplated. In one aspect shown in FIG. 3A, inlet 180 includes inlet ball valve 111 seated in sealing fashion within a cone 164 formed on the interior facing of end 163. At one, two, or three angled retention members 165 extend axially and inwardly to restrain the vertical displacement of ball 111 as fluid is admitted into the chamber during pump actuation. Further, members 165 extend above the cone section 164 so as to form a gap with housing side wall 166 into which spring 129 is nested/retained.

Figure 3B:
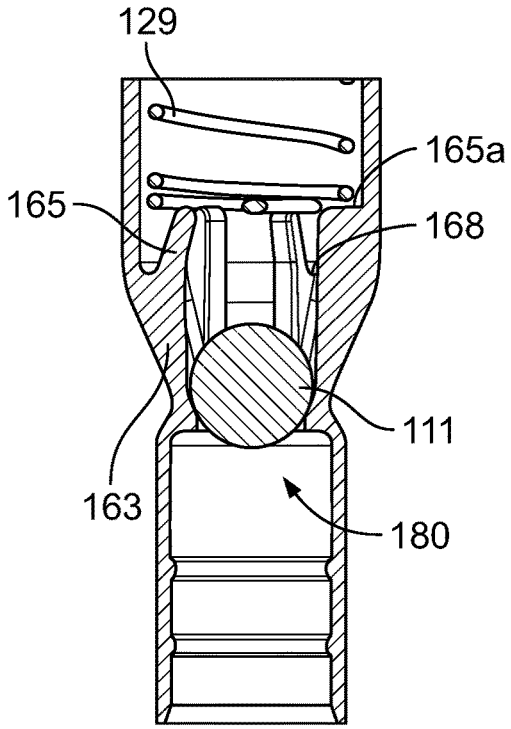
Figure 3C:
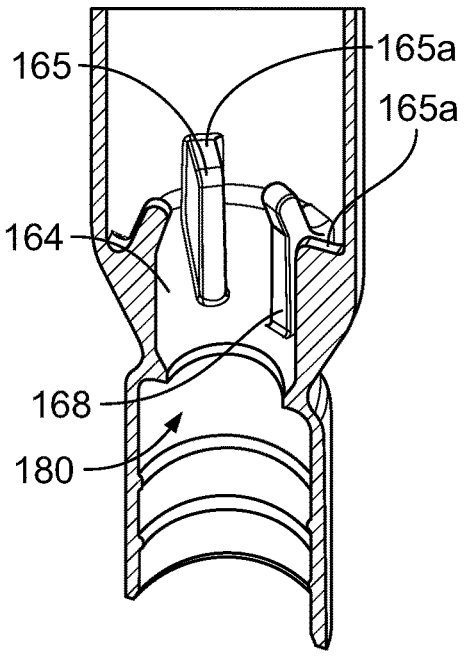
FIG. 3C is a partial cross sectional perspective view of that same view but without the ball or spring shown.

A second aspect of bottom end 163 is shown in FIGS. 3B and 3C. Here, the ball 111 rests within the cone 164, while angled retention members 165 serve the same purpose as in the first aspect above. However, one or more straight rib 168 are provided between, proximate to, or in place of the members 165. These additional straight ribs 168 help to prevent the ball 111 from becoming wedged between two of the members 165.

More generally, the positioning and height of all the members 165 and/or ribs 168 ensures the ball will always naturally fall to the center during assembly for robust, consistent placement. As an additional feature, a ledge 165*a* may be included on the member 165 (in any of these aspects) so that the spring 129 now rests thereon. Additionally or alternatively, a similar ledge 165*a* can be formed on the ribs 168 for the same purpose. As above, the spacing and shape of members 165 can be arranged similar to members 145 so as to allow for removal of ball 111 and cleaning of all the associated parts.

In any of these illustrated aspects, attachment means for coupling to a dip tube are disposed on the inner or outer diameter of wall 164 at end 163. As above, these means may include any type of interference, rotational, or snap fitting structures.

Along where contact is made with piston 140 at the top end and/or the cone 164 or at inlet 180), the terminal ends of the spring 129 make contact along these planar surfaces to exert the necessary biasing forces. These ends may possess a slight conical shape (inward or outward); however, its interior diameter should still be sufficient to engage in the fitted relationships noted above.

Spring 129 should be made from a suitable strong and corrosion resistant material, such as appropriate polymers or any number of food grade metals and/or stainless steels (e.g., series 300, such as 304, or series 400, such as 430). The unitary extension of the plunger stem 170 (see below) may also be formed from an L-, J-, or C-shaped hollow tube made from stainless or other steel, as well as any appropriate, food-grade polymeric material(s).

Another aspect of the invention relates to the dispenser head 200. Generally speaking, head 200 includes cover or shroud 210 that is detachable fitted to a skeleton 230 formed on tubular dispensing channel 220. A plurality of attachment points 231, 232 couple to and hold the shroud 210 in place, preferably by way of snap-fitting tabs.

Channel 220 may be formed as a unitary extension of the plunger stem 170 described above. In this manner, a bent metal tube and/or a single molded plastic piece can be employed even though the component is denoted by separate reference numerals. One advantage of this arrangement is that eliminates the need for separate components and any problems with coupling and sealing them together. Further, a tube with a smooth and consistent facing provides for greater flexibility in attaching the skeleton and/or shroud, as described below.

Skeleton 230 encases and attaches to dispensing channel 220, which is itself a hollow, tubular passage and an extension of channel F. Skeleton 230 includes a reinforcing web made of a sufficiently strong polymeric material. Any number of windows and ribs may be formed or omitted from the skeleton 230, depending upon the desired rigidity, connection points to shroud 210, materials costs, manufacturing and assembly methods, and the like. Also, one or more weirs may be disposed within channel 220 to guard against unwanted dripping.

Figure 4A:
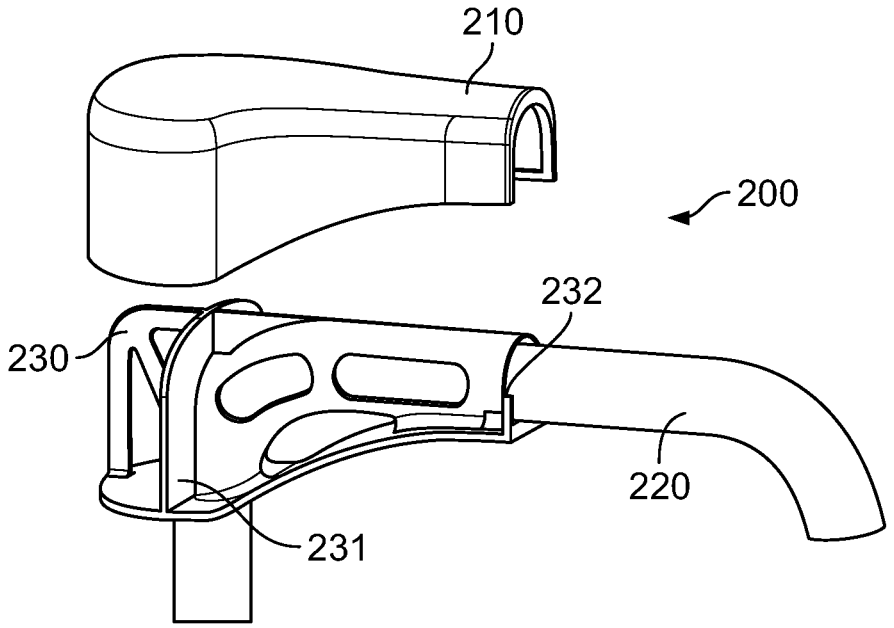
FIG. 4A is an exploded perspective view of a first aspect of the actuator head of the pump mechanism.
Figure 4B:
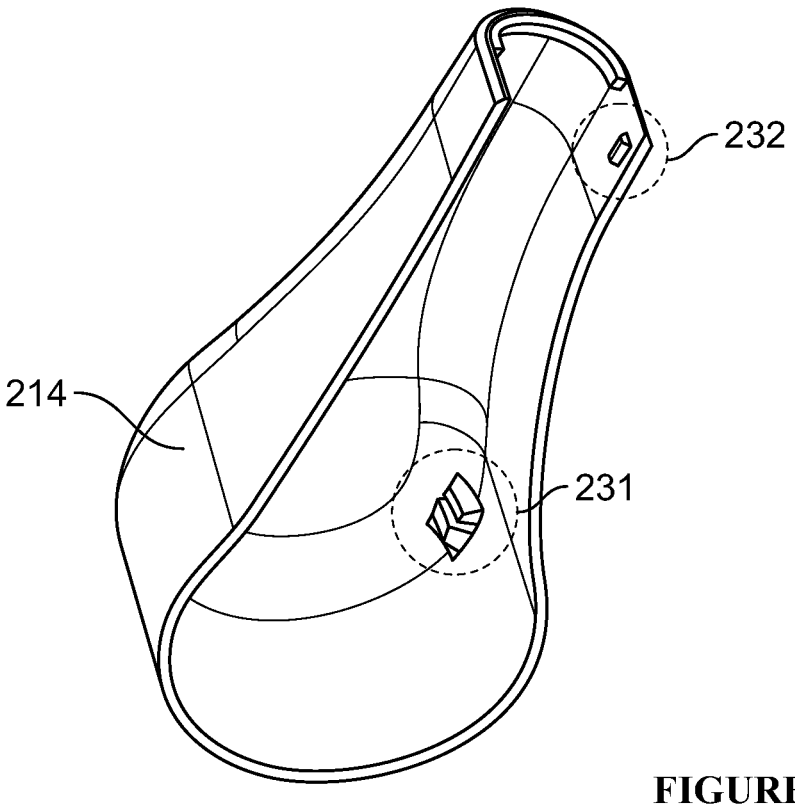
FIG. 4B is a perspective view of the underside of the shroud of the aspect illustrated in FIG. 4A.
Figure 4C:
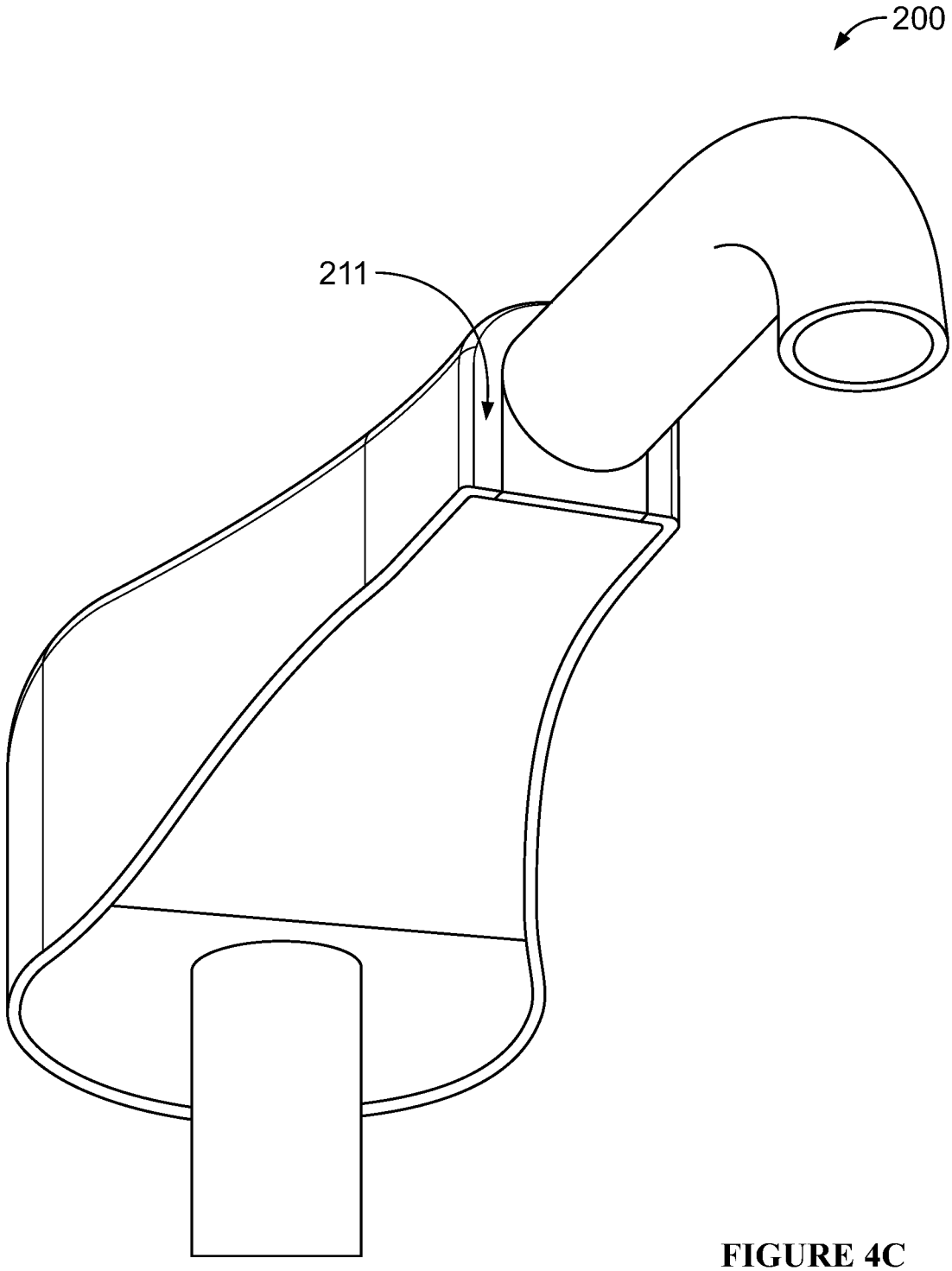
FIG. 4C is a perspective view of the actuator head of the aspect illustrated in FIG. 4A.

As seen in FIGS. 4B and 4C, an open, saddle shaped shroud 214 fits downward over the tubular dispenser 220. A gap 211 provides clearance for proper fitment, although a slightly resilient construction of the shroud 214 at this point would enable a further attachment point between it and dispenser tube 220.

Figure 5A:
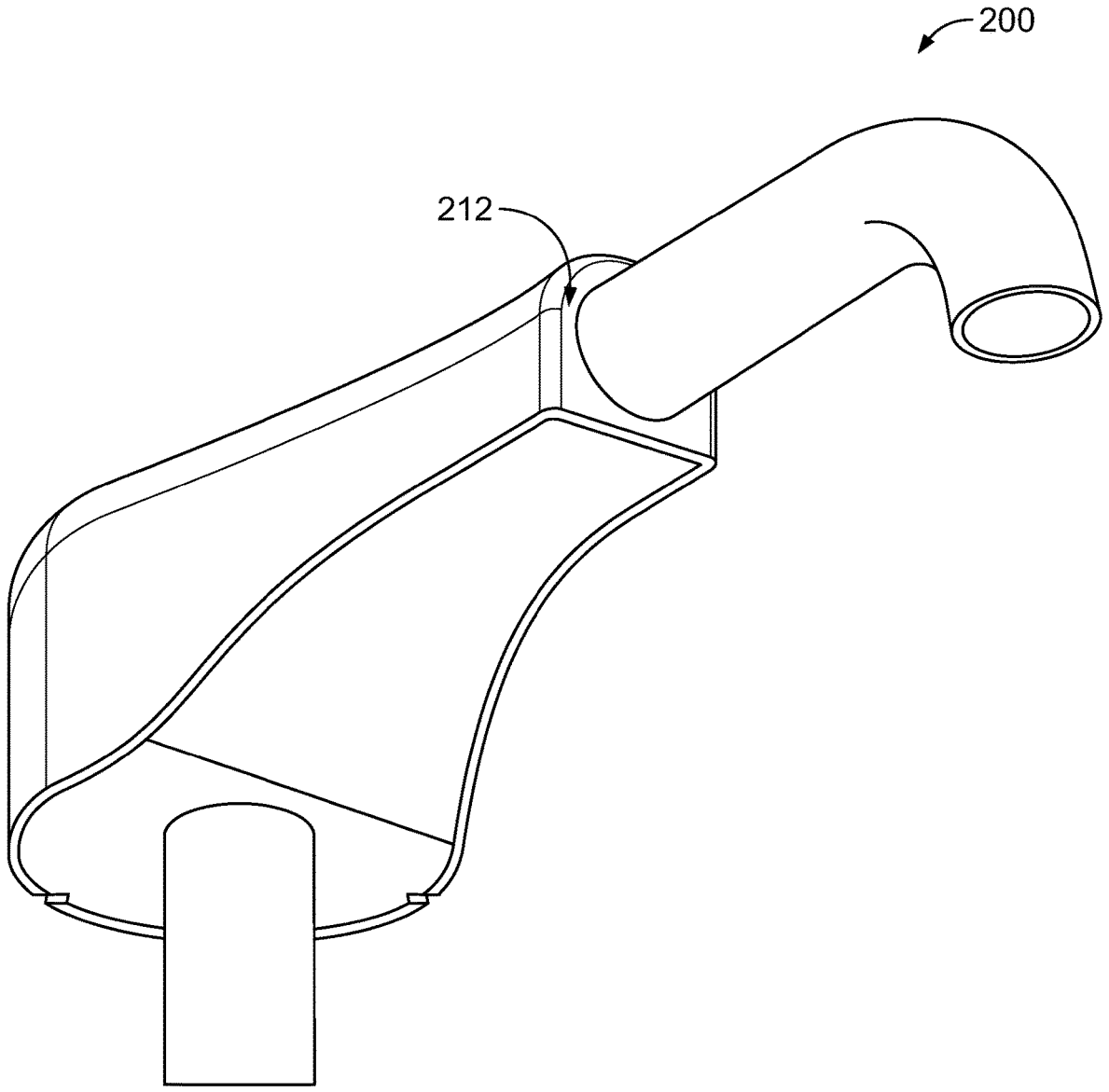
FIG. 5A is a perspective view of a second aspect of the actuator head of the pump mechanism.
Figure 5B:
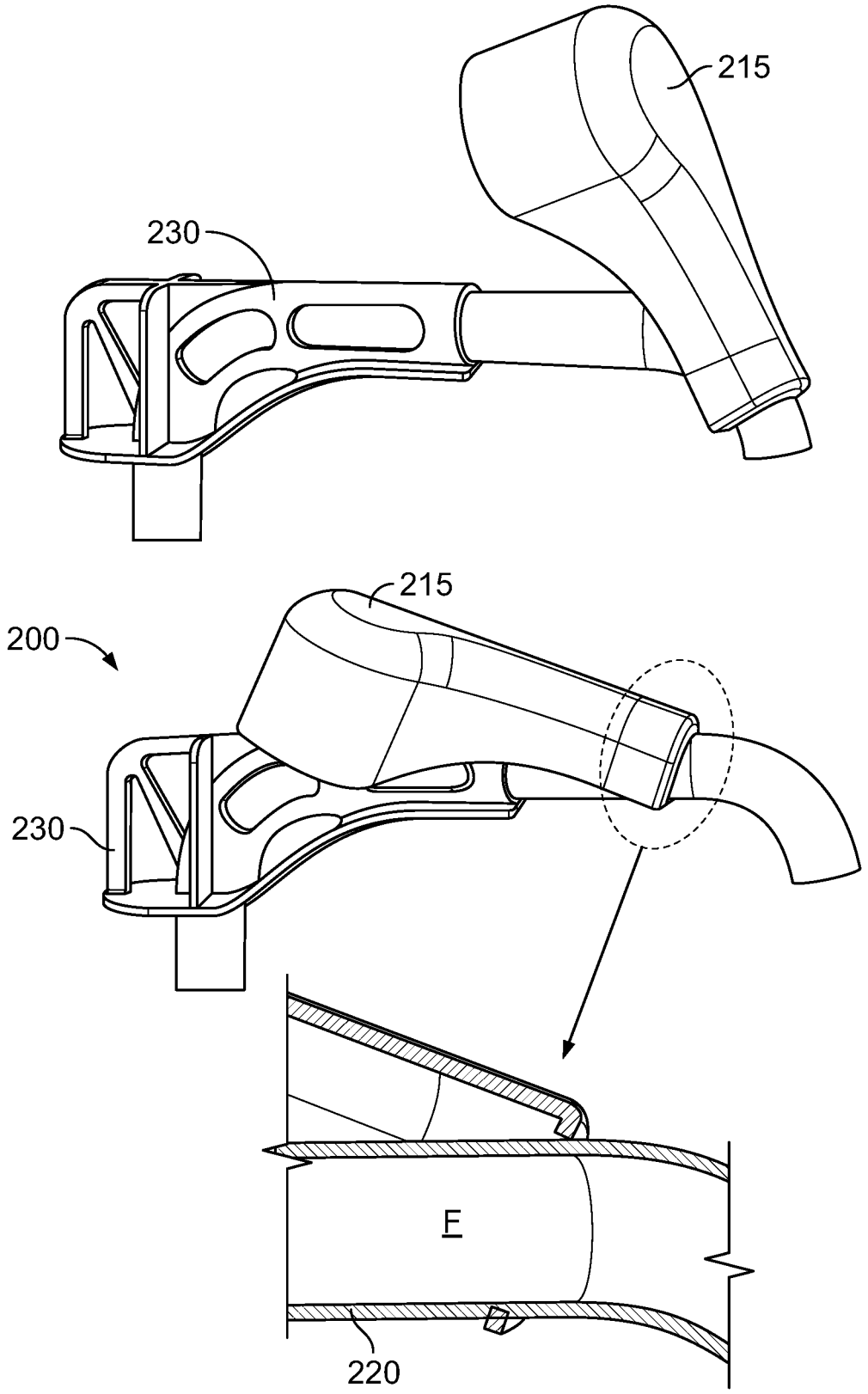
FIG. 5B is a sequential perspective view of the assembly of the second aspect illustrated in FIG. 5A.

Another aspect of the attachment for dispenser 200 is shown in FIGS. 5A and 5B. Here, shroud 215 includes an aperture 212 that must be slidingly fitted from the end of tubular dispenser channel 220. In this manner, shroud 215 can then be pivoted down onto skeleton 230 and held in place by gravity alone, without the need for additional attachments 231, 232 (although these could still be provided to ensure a more secure fit).

In either of these dispenser arrangements, it becomes possible to quickly and easily remove the shroud 210 for cleaning and/or replacement. This approach also enables the end user to employ and/or interchange shrouds of various colors, shapes, and sizes, so as to help distinguish the fluid being dispensed.

The foregoing arrangement allows for the disassembly and reconnection of all internal components without the need for special tooling. In turn, this leads to a pump arrangement that is easy to deconstruct, clean, reassemble, and selectively replace parts. As such, the inventive pump is ideally suited for food service industry applications. Further, the robust construction and ability to accommodate a large spring and pump chamber ensures the pump is capable of moving highly viscous fluids, such as sauces, condiments, and heavy creams/oils with minimal effort.

The embodiment depicted herein is particularly well suited to doses between 15 to 30 mL, although the dosing size of the pump may be controlled by adjusting the length and/or diameter of the housing and other components defining the pump chamber. Dosing restrictors can be provided within the pump chamber to allow for further adjustment of the dosing size.

In terms of manufacture, the assembly reduces the number of parts in comparison to existing, commercially viable pumps, and it eliminates the need for specialized parts, such as duckbill valves and/or other items relying upon costly elastomeric materials and/or tortuous or otherwise difficult to access and clean passageways. Further still, the easy interchangeability of the shroud 210 allows for customization, while the ease of cleaning enables the reuse of a single pump for different fluids.

Most notably, with respect to the positioning of the outlet 110 and inlet valves 111, the pumping chamber is now confined completely within the body of the pump. This arrangement allows for cleaning the entirety of the flowpath in stem 170/channel 220, insofar as the outlet valve does not create an obstruction. To the extent head 47 connects to stem 54*t* it also eliminates a sealing interface and the possibility for leakage that goes along with it. Lastly, by reducing the volume between the inlet and outlet valves, the pump will prime more quickly in comparison to those having an outlet valve in the plunger head or at the top of the stem. As such, pump and, more specifically, the outlet 100 and dispensing channel 220 are easier to clean and more reliable in its operation in comparison to prior art designs.

Specific disclosed embodiments include a dispensing tube including a plunger stem at one end of the dispensing tube; a closure having a cylindrical body coaxially receiving the plunger stem so as to accommodate reciprocal motion of the dispensing tube; a housing having an inlet valve member positioned proximate to an inlet end of the housing, said housing coupled to the closure; a piston having a central aperture contained within the housing wherein, in response to force applied by the plunger stem, the piston is movable toward the inlet end so as to vary a sealed volume of a pump chamber defined by the housing, the inlet valve member, the piston, and the central aperture; a insert having a tubular body with a web extending radially inward, said insert: detachably coupled to the piston or detachably held proximate to the terminal end; an outlet valve member held between the central aperture of the piston and the web of the insert so that, when the insert is detached from the piston or the terminal end, the outlet valve member may be removed and cleaned; and a biasing member urging the piston away from the first end, along with any combination of the following:

- wherein the dispensing tube has a substantially L-, J-, or C-shape;
- wherein the dispensing head comprises a detachable shroud coupled to a portion of the dispensing tube above the closure;
- wherein the portion of the dispensing tube includes a skeleton and the detachable shroud is coupled to the skeleton;
- wherein the piston comprises a disc-shaped body oriented orthogonally to an inner sidewall of the housing, said disc-shaped body having: (i) a central aperture in which the outlet valve member rests in a sealing relationship, (ii) a cylindrical wall encircling the central aperture on a top facing of the disc, and (iii) a peripheral flange extending above and/or below the disc-shaped body, said peripheral flange sealingly engaging the inner sidewall;
- wherein the insert is detachably coupled to the cylindrical wall;
- wherein the piston includes a plurality of outlet valve restraining members positioned around the central aperture;
- wherein the outlet valve insert includes a top portion having a larger diameter in comparison to a bottom portion;
- wherein the closure includes a chaplet positioned above and partially within the cylindrical body, said chaplet attached to the housing and forming a stopper to restrict the upward movement of the piston by abutting a top edge of the outlet valve insert;
- wherein the dispensing tube is formed from a single unitary tubular member defining an uninterrupted internal flow path from the plunger stem to an outlet formed at a second end of the dispensing tube;

wherein the biasing member is confined within the pump chamber;

wherein the insert is detachably held to the terminal end;

wherein the inlet end includes a plurality of inlet valve restraining members positioned around an inlet aperture formed at the inlet end;

wherein, when the housing is detached from the closure, the piston, the outlet valve member, the biasing member, the inlet valve member, and the dispensing tube may be individually separated and cleaned; and wherein the web extends inward a sufficient distance to restrain movement of the outlet valve member as the dispenser is actuated.

All components should be made of materials having sufficient flexibility and structural integrity, as well as a chemically inert nature. The materials should also be selected for workability, cost, and weight. In addition to the materials specifically noted above, common polymers amenable to injection molding, extrusion, or other common forming processes should have particular utility, although metals, alloys, and other composites may be used in place of or in addition to more conventional container and closure materials.

References to coupling or attachment in this disclosure are to be understood as encompassing any of the conventional means used in this field. In addition to specific structures are depicted, these conventional means may take the form of snap- or force fitting of components, although threaded connections, bead-and-groove, and/or slot-and-flange assemblies could be employed depending upon the context and feasibility of accommodating such alternative arrangements. Adhesive and fasteners could also be used for more permanent (i.e., non-detachable) connections, although such components must be judiciously selected so as to retain the underlying design goals inherent to the assembly.

In the same manner, engagement may involve coupling or an abutting relationship. These terms, as well as any implicit or explicit reference to coupling, will should be considered in the context in which it is used, and any perceived ambiguity can potentially be resolved by referring to the drawings. Components that are indicated as movable or removable will have the ability to be displaced within a range of motion, but these components may still create temporary fluidic seals as appropriate to the context of the disclosure.

Further aspects of the invention may be discerned from careful study of the features illustrated in the drawings. While structures that are most pertinent to the operation are highlighted above, still further functions and structures will be appreciated by skilled persons upon studying the drawings in their entirety. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A washable pump dispenser comprising:

a dispensing tube including a plunger stem at one end of the dispensing tube;

a closure having a cylindrical body coaxially receiving the plunger stem so as to accommodate reciprocal motion of the dispensing tube;

a housing having an inlet valve member positioned proximate to an inlet end of the housing, said housing coupled to the closure;

a piston having a central aperture contained within the housing wherein, in response to force applied by the plunger stem, the piston is movable toward the inlet end so as to vary a sealed volume of a pump chamber defined by the housing, the inlet valve member, the piston, and the central aperture;

a insert having a tubular body with a web extending radially inward, said insert: detachably coupled to the piston or detachably held proximate to a terminal end of the piston;

an outlet valve member held between the central aperture of the piston and the web of the insert so that, when the insert is detached from the piston or the terminal end, the outlet valve member may be removed and cleaned;

a biasing member urging the piston away from the first end; and wherein the closure includes a chaplet positioned above and partially within the cylindrical body, said chaplet attached to the housing and forming a stopper to restrict the upward movement of the piston by abutting a top edge of an outlet valve insert formed on the piston.

2. The dispenser of claim 1 wherein the dispensing tube has a substantially L-, J-, or C-shape.

3. The dispenser of claim 2 wherein a dispensing head disposed at an opposing end of the dispensing tube in comparison to the plunger stem comprises a detachable shroud coupled to a portion of the dispensing tube above the closure.

4. The dispenser of claim 3 wherein the portion of the dispensing tube includes a skeleton and the detachable shroud is coupled to the skeleton.

5. A washable pump dispenser comprising:

a dispensing tube including a plunger stem at one end of the dispensing tube;

a closure having a cylindrical body coaxially receiving the plunger stem so as to accommodate reciprocal motion of the dispensing tube;

a housing having an inlet valve member positioned proximate to an inlet end of the housing, said housing coupled to the closure;

a piston having a central aperture contained within the housing wherein, in response to force applied by the plunger stem, the piston is movable toward the inlet end so as to vary a sealed volume of a pump chamber defined by the housing, the inlet valve member, the piston, and the central aperture;

a insert having a tubular body with a web extending radially inward, said insert: detachably coupled to the piston or detachably held proximate to a terminal end of the piston;

an outlet valve member held between the central aperture of the piston and the web of the insert so that, when the insert is detached from the piston or the terminal end, the outlet valve member may be removed and cleaned;

a biasing member urging the piston away from the first end; and wherein the piston comprises a disc-shaped body oriented orthogonally to an inner sidewall of the housing, said disc-shaped body having: (i) a central aperture in which the outlet valve member rests in a sealing relationship, (ii) a cylindrical wall encircling the central aperture on a top facing of the disc, and (iii) a peripheral flange extending above and/or below the disc-shaped body, said peripheral flange sealingly engaging the inner sidewall.

6. A washable pump dispenser comprising:

a dispensing tube including a plunger stem at one end of the dispensing tube;

a closure having a cylindrical body coaxially receiving the plunger stem so as to accommodate reciprocal motion of the dispensing tube;

a housing having an inlet valve member positioned proximate to an inlet end of the housing, said housing coupled to the closure;

a piston having a central aperture contained within the housing wherein, in response to force applied by the plunger stem, the piston is movable toward the inlet end so as to vary a sealed volume of a pump chamber defined by the housing, the inlet valve member, the piston, and the central aperture;

a insert having a tubular body with a web extending radially inward, said insert: detachably coupled to the piston or detachably held proximate to a terminal end of the piston;

an outlet valve member held between the central aperture of the piston and the web of the insert so that, when the insert is detached from the piston or the terminal end, the outlet valve member may be removed and cleaned;

a biasing member urging the piston away from the first end; and wherein the insert is detachably coupled to a cylindrical wall defining a portion of the plunger stem and wherein the piston includes a plurality of outlet valve restraining members positioned around the central aperture.

7. The dispenser of claim 1 wherein piston includes an outlet valve insert with a top portion having a larger diameter in comparison to a bottom portion.

8. The dispenser of claim 1 wherein the dispensing tube is formed from a single unitary tubular member defining an uninterrupted internal flow path from the plunger stem to an outlet formed at a second end of the dispensing tube.

9. The dispenser of claim 1 wherein the biasing member is confined within the pump chamber.

10. The dispenser of claim 1 wherein the insert is detachably held to the terminal end.

11. The dispenser of claim 1 wherein the inlet end includes a plurality of inlet valve restraining members positioned around an inlet aperture formed at the inlet end.

12. The dispenser of claim 1 wherein, when the housing is detached from the closure, the piston, the outlet valve member, the biasing member, the inlet valve member, and the dispensing tube may be individually separated and cleaned.

13. The dispenser of claim 1 wherein the web extends inward a sufficient distance to restrain movement of the outlet valve member as the dispenser is actuated.

14. The dispenser of claim 5 wherein the dispensing tube is formed from a single unitary tubular member defining an uninterrupted internal flow path from the plunger stem to an outlet formed at a second end of the dispensing tube.

15. The dispenser of claim 5 wherein the biasing member is confined within the pump chamber.

16. The dispenser of claim 5 wherein, when the housing is detached from the closure, the piston, the outlet valve member, the biasing member, the inlet valve member, and the dispensing tube may be individually separated and cleaned.

17. The dispenser of claim 5 wherein the dispensing tube has a substantially L-, J-, or C-shape.

18. The dispenser of claim 5 wherein the insert is detachably held to the terminal end.

* * * * *